United States Patent [19]

Oda et al.

[11] 4,348,810

[45] Sep. 14, 1982

[54] BLADE PART ASSEMBLING STRUCTURE FOR ELECTRIC SHAVER

[75] Inventors: Takeshi Oda; Hiroshi Kikuchi, both of Kadoma, Japan

[73] Assignee: Matsushita Electric Works, Ltd., Osaka, Japan

[21] Appl. No.: 250,741

[22] PCT Filed: Jun. 26, 1979

[86] PCT No.: PCT/JP79/00165

§ 371 Date: Feb. 29, 1980

§ 102(e) Date: Feb. 29, 1980

[87] PCT Pub. No.: WO80/00141

PCT Pub. Date: Feb. 7, 1980

[30] Foreign Application Priority Data

Jun. 30, 1978 [JP] Japan ..... 53/80383

[51] Int. Cl.[3] ..... B26B 19/04

[52] U.S. Cl. ..... 30/210; 30/221; 30/200

[58] Field of Search ..... 30/195, 196, 200, 209, 30/210, 221, 222, 223

[56] References Cited

U.S. PATENT DOCUMENTS

| | | | |
|---|---|---|---|
| 2,465,694 | 3/1949 | Norwood | 30/221 |
| 2,717,443 | 9/1955 | Turbett | 30/210 |
| 2,827,695 | 3/1958 | Vitale | 30/210 |
| 2,883,747 | 4/1959 | Johnson | 30/210 |
| 3,046,654 | 7/1962 | Letchfield | 30/210 X |
| 3,372,481 | 3/1968 | Skinner | 30/210 |
| 3,561,115 | 2/1971 | Palm | 30/222 X |
| 4,146,960 | 4/1979 | Flowers | 30/195 |

FOREIGN PATENT DOCUMENTS

| | | | |
|---|---|---|---|
| 54-6650 | 1/1979 | Japan | 30/223 |
| 54-6651 | 1/1979 | Japan | 30/223 |
| 54-154663 | 12/1979 | Japan | 30/200 |
| 54-154664 | 12/1979 | Japan | 30/200 |

*Primary Examiner*—Jimmy C. Peters

*Attorney, Agent, or Firm*—Burns, Doane, Swecker & Mathis

[57] ABSTRACT

The blade part assembling structure for electric shaver of this invention comprises fitting pins which are rotatably fitted to a blade mounting base, a movable blade mounted on the base in the first rotating positions of the fitting pins, and a stationary blade mounted on the base in the second rotating positions so that, in the case of dismounting the stationary blade, the movable blade will be locked with the fitting pins in the rotated positions of the fitting pins and any occurence of troubles during disassembling and re-assembling of the blade part by the user can be avoided.

9 Claims, 14 Drawing Figures

BLADE PART ASSEMBLING STRUCTURE FOR ELECTRIC SHAVER

TECHNICAL FIELD

This invention relates to blade part assembling structures for electric shavers and, more particularly, to a blade part assembling structure for electric shavers wherein only a stationary blade performing a cutting action in cooperation with a movable blade can be dismounted from a blade block detachably mounted to a housing.

BACKGROUND ART

Referring concretely to a blade part assembling structure for electric shaver of the kind referred to which has been general, bosses are provided to project on a base which forming a part of the housing of the electric shaver, a push-up spring and movable and stationary blades are arranged to be overlapped onto each other so as to be sequentially inserted to these bosses, fitting pins having a disk-shaped flange part are urged into the bosses so as to hold the stationary blade in the uppermost position with the lower surface of the disk-shaped flange part of the fitting pin to thereby mount the blade block to a blade holder. However, in the case of, for example, sweeping cut hairs entered between the movable blade and the stationary blade in such conventional concrete example, the fitting pins urged into the bosses are pulled out and the stationary blade is dismounted to be cleaned but, in this case, the movable blade and push-up spring will be also dismounted from the base, simultaneously with the dismounting of the stationary blade. This will bring about various disadvantages when the electric shaver is actually used. That is, there have been problems that, in the case of reassembling the blade block after the sweeping is completed, the push-up spring and movable blade are mounted on the base, then the stationary blade is arranged to be overlapped on them and the fitting pins is pressed in and thus the reassembling is very troublesome and inconvenient, and that, if the blade block is disassembled by an unskilled person, chances of trouble occurrence in the blade block and of loosing any one of these parts will increase.

Further, the stationary blade 3 and movable blade 2 have been rigid blades of a thick material so that, though the sliding surfaces between the stationary blade 3 and movable blade 2 are finished by grinding or the like, a warp of about 0.01 mm will be produced and, when these blades are assembled, a clearance of about 0.02 mm will take place, whereby there has been caused such problem that, in case such very fine hair of about 0.005 mm as downy hair is to be cut, such hair will be held in the clearance between the stationary blade 3 and the movable blade 2 and cannot be cut at all.

DISCLOSURE OF THE INVENTION

A primary object of the present invention is, therefore, to provide a blade part assembling structure for electric shaver wherein only a stationary blade can be dismounted and overhauled undependently of a movable blade and push-up spring and a blade block can be simply and reliably disassembled and assembled.

Another object of the present invention is to provide a blade part assembling structure for electric shaver wherein one blade is made flexible and the comb-shaped teeth of this blade are brought into close contact with those of the other blade so that there may be no clearance between the stationary blade and movable blade and even such fine hair as downy hair can be smoothly cut.

Another object of the present invention is to provide a blade part assembling structure for electric shaver which is suitable for shaving hair one by one in the case of, for example, shaving eyebrows.

Another object of the present invention is to provide a blade part assembling structure for electric shaver having a push-up means which can bring the blades into close contact with each other.

Other objects of the present invention will be made gradually apparent with the following disclosure with reference to embodiments.

Now, according to the present invention, the above described conventional problems are solved in such that laterally extended fitting holes with its major diameter lying in the direction perpendicular to sliding direction of the movable blade are formed while the stationary blade is mounted by means of rotatable fitting pins having an upper end flange part of such elongated shape as a rectangular, elliptic or the like shape so that it is made possible to dismount only the stationary blade, and either or each of the stationary blade and movable blade is made resilient by rendering the thickness in their material or only of the blade edge portion to be small.

BRIEF EXPLANATION OF DRAWINGS

The disclosure shall be made in the followings with reference to drawings showing embodiments of the present invention. FIG. 1 is a perspective view showing an appearance of an example of the blade part assembling structure of electric shaver to which the present invention is to be applied. In this electric shaver, a blade holder 2 is extended out of one end of a housing 1 having a reciprocating driving mechanism therein and a blade block 3 is mounted to this blade holder 2. In FIGS. 2 to 6, 4 is a base which is formed of a synthetic resin molding and provided with mounting bosses 5 projecting in a line in the reciprocating direction of a driving rod derived from a reciprocal driving mechanism. 6 is a stationary blade formed of a material of a thickness of about 0.4 mm, in which laterally extended fitting holes 8 with its major diameter lying in the direction perpendicular to the sliding direction of a movable blade 7 and both edge comb-shaped teeth are formed, the comb-shaped teeth at one edge being a short blade 9 formed only in the tip portion in the driving direction of the movable blade 7 and the comb-shaped teeth at the other edge being a long blade 10 formed to be arcuate. The comb-shaped groove width of the stationary blade 6 is formed to be somewhat larger than the diameter of hair to be 0.12 to 0.15 mm, so that hair can be less caused to fall by the movable blade as compared with conventional movable blade of a groove width of about 0.3 to 0.5 mm and even such fine hair as downy hair can be cut to be shorter. The movable blade 7 is formed of a thin material of a thickness of about 0.2 mm and is provided with sliding holes 11 formed in slots extending in the reciprocating direction of the driving rod and slidably guided by the fitting bosses 5 and with both-edge comb-shaped teeth of which the comb-shaped teeth at one edge are of a short blade 12 so as to correspond to the comb-shaped teeth of the stationary blade 6. 13 is a driving rod engaging member provided on the movable blade 7 and integrally formed of a synthetic resin molding by means of an insert-molding to be thicker than the movable blade 7. When the driving rod engaging member is thus formed of the synthetic resin molding, the driving rod will not be scraped with edge part of the movable blade 7, so that no gap will be produced between the driving rod and the driving rod engaging member, the efficiency of the drive force transmission can be prevented from being reduced and noises due to any collision of the driving rod with the engaging member can be kept low even after the use for a long time. 14 is a push-up means formed of a flat plate made thin and provided with a thickness reduction to have a resiliency and with holes 15 for fitting the mounting bosses. 16 is a fitting pin of which flange part 17 at the upper end is formed in such elongated shape as a rectangular or elliptic shape and this pin is inserted in a central hole 18 in the fitting boss 5. The inner diameter of the central hole 18 is made larger than the outer diameter of the fitting pin 16 urged therein within triangular ranges formed at least by the center of the central hole 18 and the front and rear ends of guide surface of the fitting boss 5 with which the movable blade 7 is in sliding contact as shown in FIGS. 7 and 8 whereas the inner diameter of the fitting boss 5 is made smaller than the outer diameter of the fitting pin 16 in the other ranges, whereby there are caused such effects that the guide surfaces of the fitting bosses 5 with which the movable blade 7 is in sliding contact will not be deformed by the depression of the fitting pins 16 to fix the stationary blade 6 to the fitting bosses 5, the fitting pins 16 will not float up from the central hole 18, the reciprocation of the movable blade 7 will be smooth and the movable blade 7 will contact the stationary blade under a predetermined pressure. While not shown in the drawings of the embodiment, it can be easily conceived to form a steped part in the lower end portion of the fitting pins 16 as a means for preventing the fitting pins 16 from being pulled out. The blade block 3 is formed in such that the push-up means 14 is fitted to the fitting bosses 5 of the base 4, then the sliding holes 11 of the movable blade 7 are fitted to the fitting bosses 5, further the stationary blade 6 is mounted on the upper surface of the movable blade to fit the fitting bosses 5 in the fitting holes 8 of the stationary blade 6, the fitting pins 16 are urged into the central holes 18 of these fitting bosses 5 and the lower surfaces of the flange parts 17 of the fitting pins 16 are brought into contact with the upper surfaces of the peripheral edges of the fitting holes 8 located in the same direction as the sliding direction of the movable blade, so that, when the lengthwise direction of the flange parts 17 is made to intersect at right angles the sliding direction of the movable blade 7, these flange parts 17 will freely pass through the fitting holes 8 and, with this posture of the flange parts 17, the lower surfaces of the flange parts 17 will engage the upper surfaces of both side edges of the sliding holes 11. At this time, the tip edges of the flat plate which is the push-up means 14 are on the back surfaces of the sliding parts of the movable blade and are in contact with vicinities of the comb-shaped teeth so that, being in contact with the back surfaces of the sliding parts, the movable blade 7 will be prevented from floating from the stationary blade 6 due to this action by means of the push-up means 14. It is needless to say that the sliding parts of the movable blade 7 include the ones in the form of points for reducing the sliding resistance. Further, as a means for preventing the stationary blade 6 from being deformed by the pressing force of the fitting pin 16, a projection 19 higher than the thickness of the stationary blade 6 is formed at the tip of the fitting boss 5 to correspond to the fitting hole 8 made in the stationary blade 6 so as to give a freedom to the stationary blade 6.

Figure 1:
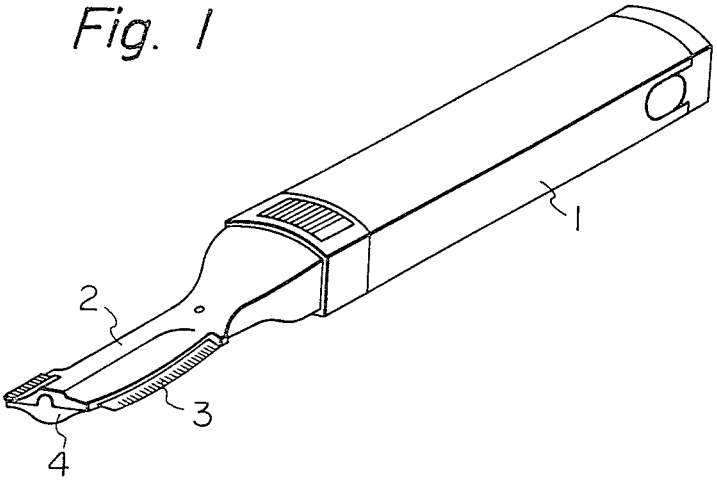
FIG. 1 is a perspective view showing in appearance an example of an electric shaver to which the present invention is applied.
Figure 4:
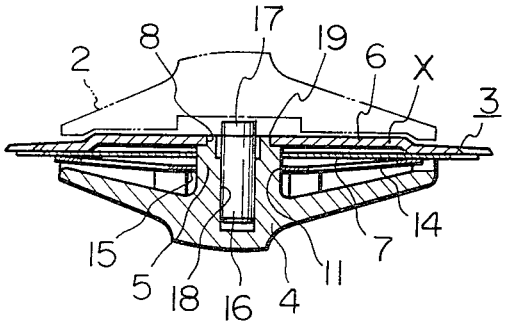
FIG. 4 is a sectioned view on line D—D of the same.
Figure 2:
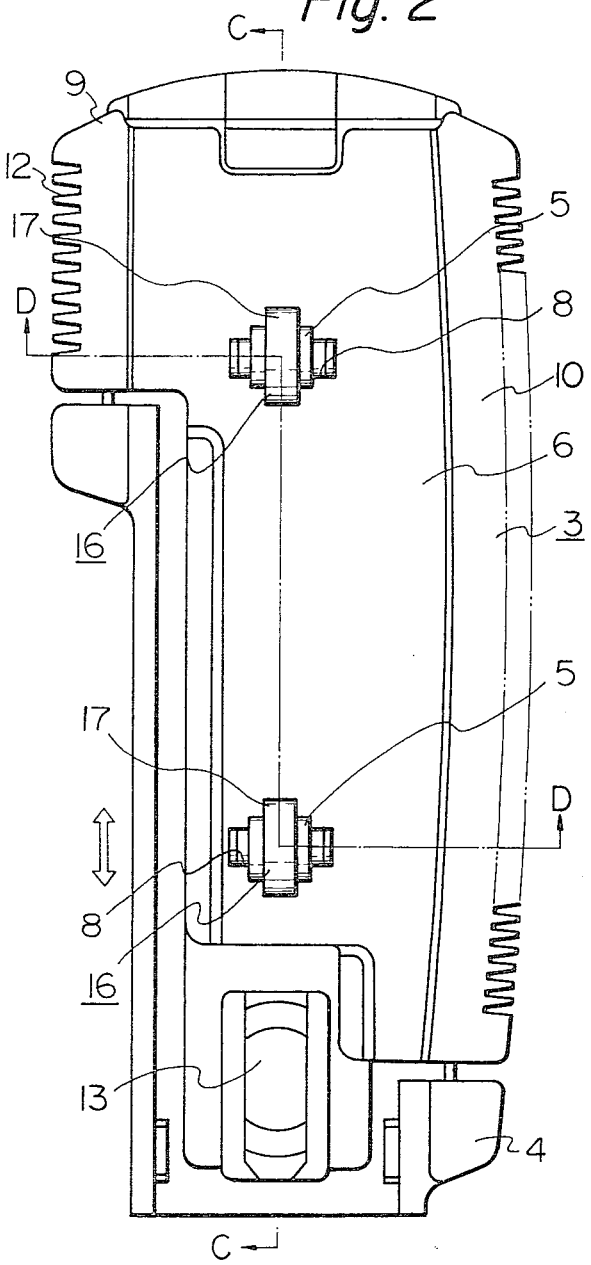
FIG. 2 is a magnified upper plan view of an embodiment of the present invention.
Figure 3:
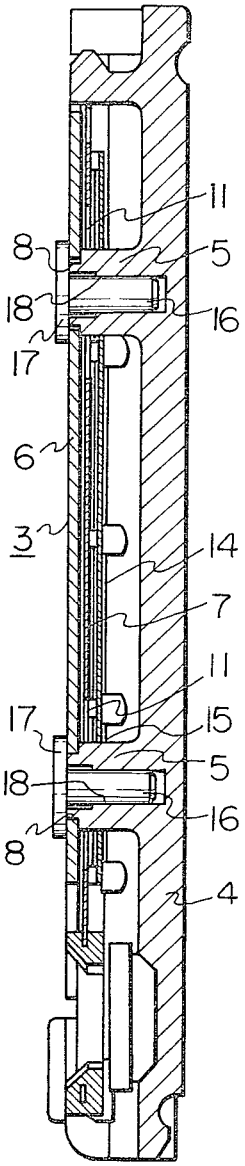
FIG. 3 is a sectioned view on line C—C of the same.
Figure 5:
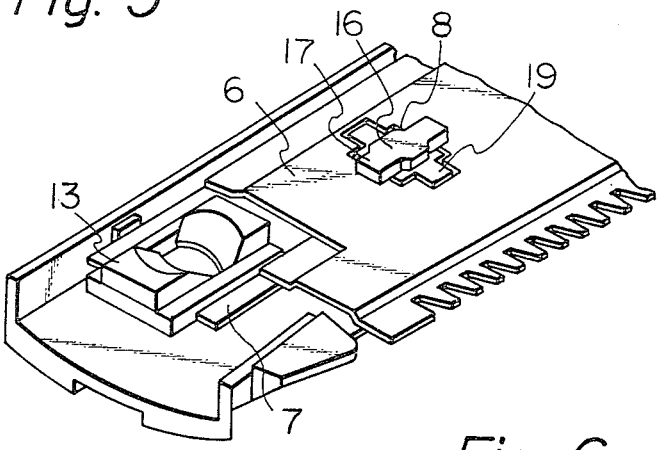
FIG. 5 is a perspective view showing the appearance of an essential part of a blade block.
Figure 6:
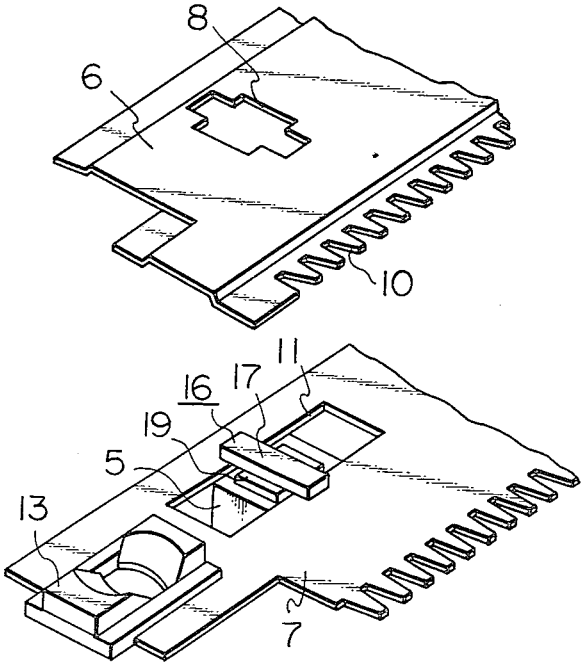
FIG. 6 is magnified perspective view of an essential part of the same.
Figure 7:
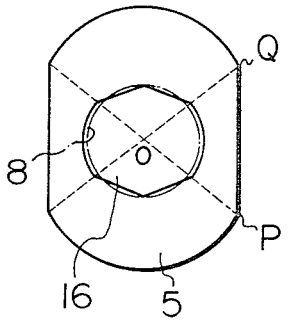
FIG. 7 is an upper plan view of a fitting boss of the same.
Figure 8:
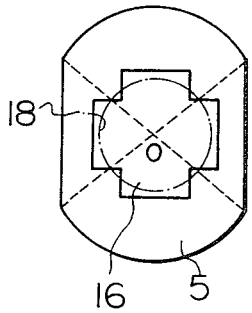
FIG. 8 is an upper plan view of another embodiment of the fitting boss.

In the above described embodiment, the flange parts 17 are made to have a lengthwise direction coinciding with the sliding direction of the movable blade 7 and are holding with their lower surfaces the upper surfaces of the front and rear peripheral edge portions of the fitting holes 8 to fix the blade block 3. Now, in the case of sweeping cut hair X or the like entered between the movable blade 7 and the stationary blade 6, the fitting pins 16 as fitted in the holes are rotated by 90 degrees to have the lengthwise direction of the flange parts 17 positioned to intersect at right angles the sliding direction of the movable blade 7. Thus the lengthwise direction of the flange parts 17 will coincide with the major diameter of the fitting holes 8, the flange parts 17 are allowed to pass through the fitting holes 8 to render the stationary blade 6 capable of being pulled out but, on the other hand, as the lengthwise direction of the flange parts 17 are intersecting at right angles the sliding direction of the movable blade 7, the lower surfaces of both end portions in the lengthwise direction of the flange parts 17 are caused to engage the upper surfaces of both side edges of the sliding holes 11 formed in the movable blade 7 and the movable blade 7 is caused to engage the flange parts 17 of the fitting pins 16, whereby the movable blade and push-up means 14 are prevented from being dismounted from the base 4. In dismounting the movable blade 7 and push-up means 14 from the base 4, the fitting pins 16 are further rotated by 90 degrees from the above state to have the lengthwise direction of the flange parts 17 again coincided with the sliding direction of the movable blade 7.

Figure 9:
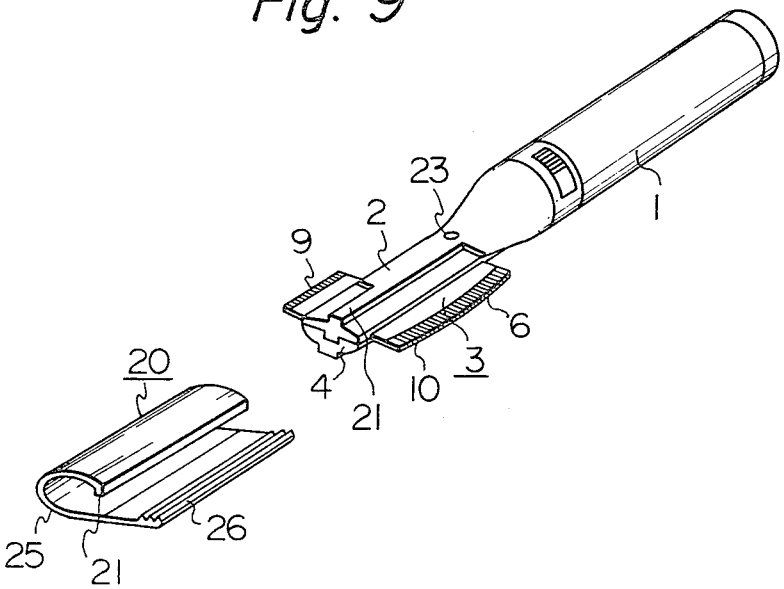
FIG. 9 is a perspective view of an appearance of the electric shaver and attachment.
Figure 10:
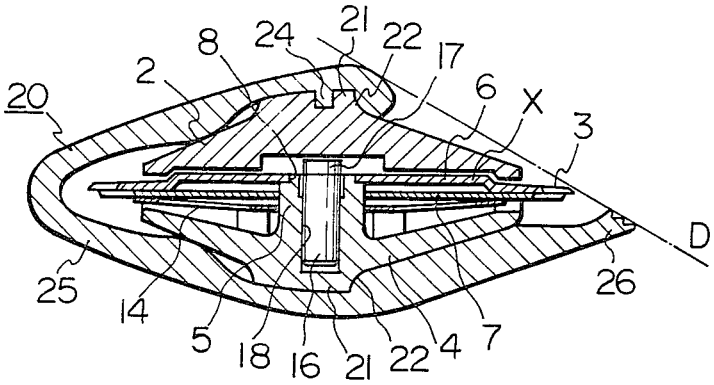
FIG. 10 is a sectioned view of an attachment as mounted.
Figure 11:
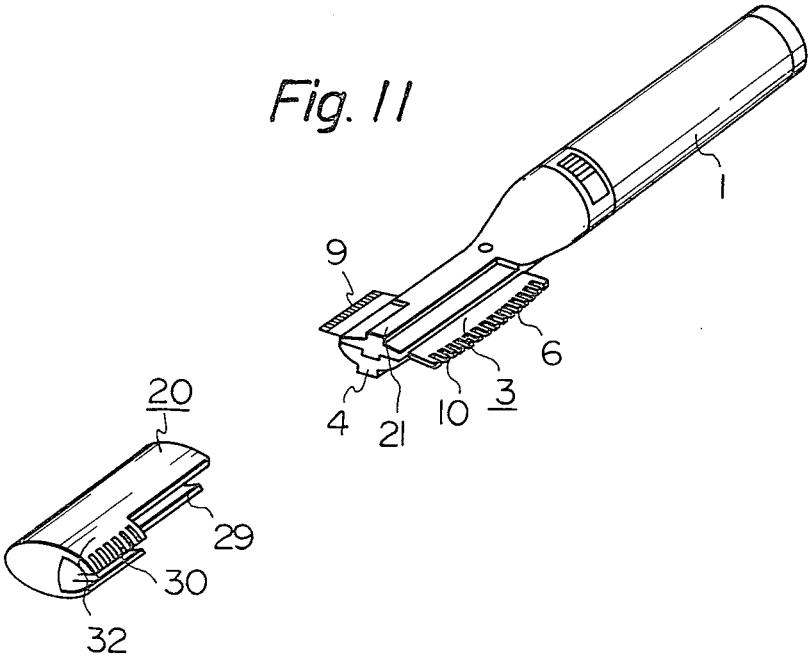
FIG. 11 is an appearance view corresponding to FIG. 9 of another embodiment of the attachment.
Figure 12:
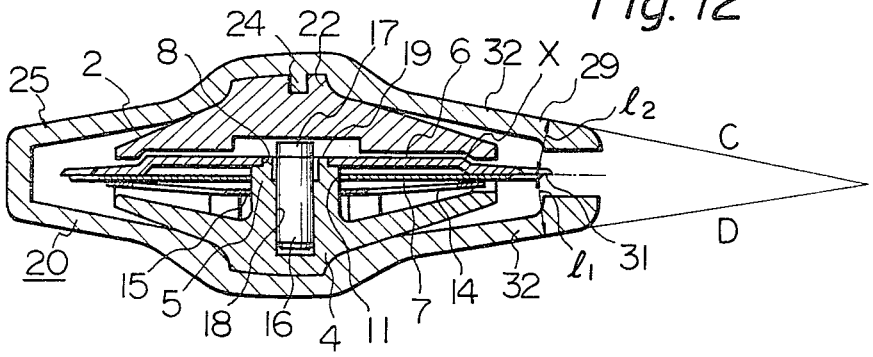
FIGS. 12 to 14 are sectioned views corresponding to FIG. 9 of other embodiments of the attachment.
Figure 13:
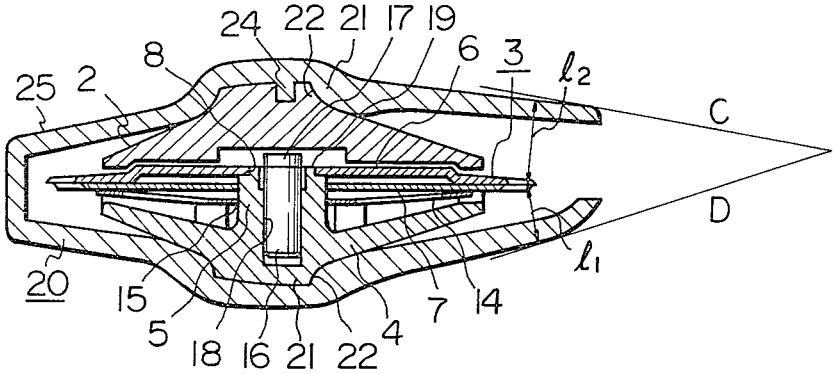

FIGS. 9 to 13 are views of an embodiment of an attachment detachably fitted to the electric shaver to improve the easiness in use of the electric shaver, wherein a guide projection 21, guide groove 22, positioning recess 23 and positioning projection 24 are formed respectively in an attachment 20, blade holder 2 and base 4 to protect the blades and prevent any rattling of the attachment. The attachment shown in FIGS. 9 and 10 comprises a mounting part 25 curved into a U-shape for being detachably fitted to the blade holder 2 and blade block 3, and a plate-shaped guide part 26 formed integrally with one side of the U-shape mounting part and projected close to an extension of line D connecting a tip of the mounting part 25 and the stationary blade 6. When the attachment 20 is fitted to the electric shaver, the shaver is to be used while pressing the user's skin surface naturally to the shaver on the line D connecting the tip 27 of the guide part 26 of the attachment 20 and the tip 28 of the stationary blade 6, so that no possibility of using the stationary blade 6 applied at right angles with respect to the skin surface will arise and any unskilled user will be able to well use the shaver. The cut hair will be deposited in a clearance between the stationary blade 6 and the guide part 26 of the attachment 20 and the hairs will not scatter. Since this attachment 20 is detachably mounted to the electric shaver, the use may be made with the attachment 20 detached in the event of shaving any odd hair on the hair growing boundary or the like so that hair trimming will be performed easily. In the case where the attachment is attached to the electric shaver having both of the long blade 10 and short blade 9, a safe use can be achieved while either one of the long blade and short blade is being used, without causing hair to be cut excessively or the skin to be hurt with the other blade.

Figure 14:
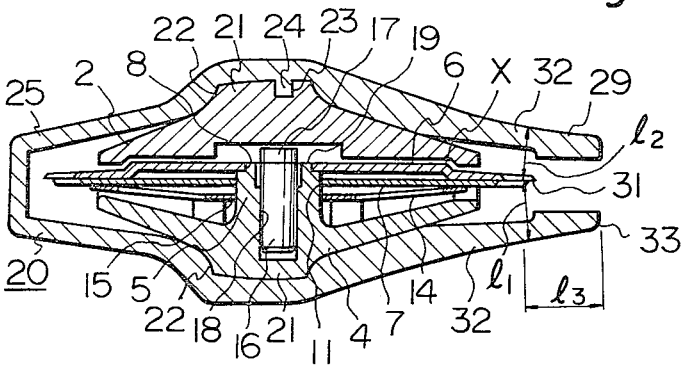

The attachments shown in FIGS. 11 to 14 comprise a U-shaped sheath part 29 opened along one side to be detachably attached to the blade holder 2 and blade block 3 and a pair of comb-shaped tooth parts 30 extending from both edges of the opened side beyond the stationary blade 6 along the outer faces of the stationary blade 6. In case the distances $l_1$ and $l_2$ between respective side faces of cutting blade part 31 formed of the stationary blade 6 and movable blade 7 and respective skin contacting surfaces 32 of the comb-shaped tooth parts 30 are made equal to each other on both sides of the cutting blade part 31, hair can be sheared at a uniform height even if either of surfaces C and D of the attachment 20 is applied to the skin. When the attachment 20 is made asymmetrical on both sides of the opening 33 and the heights $l_1$ and $l_2$ of the comb-shaped tooth parts 30 of the attachment 20 are made different from each other on both sides of the cutting blade part 31 as in FIG. 13, the shaving height will be different between the respective cases when the surface C of the attachment 20 is applied to the skin and when the surface D is applied to the skin, so that an action of replacing the attachment whenever the shaving height must be changed can be omitted and the shaver will be used conveniently. In the attachment shown in FIG. 14, the distance $l_3$ between the projection 33 of the comb-shaped tooth part 30 of the attachment 20 and the tip of the cutting blade part 31 of the shaver is made the same as or larger than each of the shaving heights $l_1$ and $l_2$. Even if the skin surface is pressed against the projections by mistake, hair will not be shaved to be too short by mistake.

In the electric shaver according to the present invention, as described above, the fitting pins rotatably urged into the fitting bosses on the base are formed in an elongated shape at the upper end flange parts and laterally extending fitting holes with the major diameter lying in the direction intersecting at right angles the sliding direction of the movable blade are formed in the stationary blade, so that there will be brought about such effects that, when the lengthwise direction of the flange parts is placed to intersect at right angles with the sliding direction, the flange parts will become free to be inserted through the fitting holes and the stationary blade can be dismounted independently of the other movable blade and push-up means while, when the lengthwise direction of the flange parts is made to coincide with the sliding direction, the lower surfaces of the flange parts will engage with the peripheral edges of the shorter sides of the fitting holes, whereby the blade block can be positively assembled, and only the stationary blade will be able to be independently dismounted so that the movable blade and push-up means will not be caused to be disassembled, and the blade block can be easily disassembled and assembled for sweeping deposited cut hair to allow such hair to be cleaned in simple manner.

We claim:

1. A blade part assembling structure for electric shaver characterized in comprising a stationary blade having comb-shaped teeth at edge portions, a movable blade having comb-shaped teeth corresponding to said comb-shaped teeth of said stationary blade and slidable with respect to the stationary blade, a push-up means for pressing said movable blade against the stationary blade, and fitting pins for mounting the stationary blade to a base, said fitting pin being formed to be rectangular or elliptic at upper end flange part and being rotatably fitted to be at least displaceable in a first position where the lengthwise direction of said upper end flange part coincides with sliding direction of the movable blade and a second position where the lengthwise direction of the upper end flange part coincides with the direction intersecting at right angles said sliding direction of the movable blade, said movable blade being provided with fitting holes longer in the sliding direction of the movable blade than the length in the lengthwise direction of the upper end flange part of the fitting pin but shorter in the direction intersecting at right angles the sliding direction, said stationary blade being provided with fitting holes shorter in the sliding direction than the length in the lengthwise direction of the upper end flange part of the fitting pin but longer in the direction intersecting at right angles the sliding direction, said movable blade allowing the flange parts of the fitting pins to pass through its fitting holes in said first positions of the fitting pins to mount the blade to the blade holder and allowing the lower surfaces of the flange parts to engage with the peripheral edges of the short sides of the fitting holes in the second positions of the fitting pins, and said stationary blade further allowing the flange parts of the fitting pins to pass through the fitting holes in the second positions of the fitting pins to mount the blade to the base and allowing the lower surfaces of the flange parts to engage with the peripheral edges of the short sides of the fitting holes in the first positions of the fitting pins.

2. A blade part assembling structure for electric shaver according to claim 1 wherein said fitting pin is rotatably fitted to a boss molded of a synthetic resin integrally with said base and side faces of said boss in said sliding direction of said movable blade are made to be guides for movements in the sliding direction of the movable blade.

3. A blade part assembling structure for electric shaver according to claim 1 wherein a steped part of a reduced diameter is formed in the upper end portion of said boss, and said fitting hole of said stationary blade is provided therethrough with sufficient gaps in the horizontal direction and vertical direction of the stationary blade in the space between said step part and the lower surface of said flange part of the fitting pin.

4. A blade part assembling structure for electric shaver according to claim 1 wherein either or both of said stationary blade and movable blade is made thin in their material or at least only in blade tip portion so as to be resilient, and the stationary and movable blades are kept in close contact with each other by said push-up means.

5. A blade part assembling structure for electric shaver according to claim 1 wherein respective said stationary and movable blades are provided with comb-shaped teeth formed at both edges and said comb-shaped teeth at one edge are of a short blade formed only in the tip portion in the driving direction of the movable blade.

6. A blade part assembling structure for electric shaver according to claim 1 wherein said movable blade is provided with an engaging member for a driving rod which reciprocates the movable blade and formed of a synthetic resin molding integrally with the movable blade.

7. A blade part assembling structure for electric shaver according to claim 2 wherein said push-up means is formed of a resilient flat plate and is made to contact at the tip edges with vicinities of said comb-shaped teeth on the back surfaces of sliding parts of the movable blade.

8. A blade part assembling structure for electric shaver according to claim 1 wherein said fitting boss for said fitting pin is also used as a guide boss for reciprocating slide of said movable blade.

9. A blade part assembling structure for electric shaver according to claim 6 wherein the inner diameter of a boss hole is made larger than the outer diameter of said fitting pin urged therein in triangular ranges formed by the center of said boss hole for fitting the fitting pin and the front end edge of the guide surface of the boss with which said movable blade is in sliding contact and the inner diameter of the boss hole is made smaller than the outer diameter of the fitting pin in the other ranges.

* * * * *